US011324269B2

(12) United States Patent
Lee

(10) Patent No.: US 11,324,269 B2
(45) Date of Patent: May 10, 2022

(54) EYELASH EXTENSION SYSTEM

(71) Applicant: UNIST(ULSAN NATIONAL INSTITUTE OF SCIENCE AND TECHNOLOGY), Ulsan (KR)

(72) Inventor: Myun-Woo Lee, Yongin-si (KR)

(73) Assignee: UNIST (ULSAN NATIONAL INSTITUTE OF SCIENCE AND TECHNOLOGY), Ulsan (KR)

( * ) Notice: Subject to any disclaimer, the term of this patent is extended or adjusted under 35 U.S.C. 154(b) by 352 days.

(21) Appl. No.: 16/524,961

(22) Filed: Jul. 29, 2019

(65) Prior Publication Data

US 2020/0288802 A1 Sep. 17, 2020

(30) Foreign Application Priority Data

Mar. 13, 2019 (KR) ..... 10-2019-0028700

(51) Int. Cl.

| | |
|---|---|
| ***A45D 2/48*** | (2006.01) |
| ***A41G 5/02*** | (2006.01) |
| ***A41G 5/00*** | (2006.01) |

(52) U.S. Cl.

CPC ..... *A41G 5/02* (2013.01); *A41G 5/0086* (2013.01); *A41G 5/008* (2013.01)

(58) Field of Classification Search

CPC . A41G 5/00; A41G 5/02; A41G 5/008; A41G 5/0086; A45D 2/48; A45D 40/30

See application file for complete search history.

(56) References Cited

U.S. PATENT DOCUMENTS 2,410,391 A * 10/1946 Palmer ..... A45D 2/48 132/217
3,511,248 A * 5/1970 Panda ..... A41G 5/02 132/216

(Continued)

FOREIGN PATENT DOCUMENTS

JP H03-080835 A 4/1991
JP 2011-005013 A 1/2011

(Continued)

OTHER PUBLICATIONS

Korean Office Action for related KR Application No. 10-2019-0028700 dated May 6, 2020 from Korean Intellectual Property Office.

(Continued)

*Primary Examiner* — Rachel R Steitz
(74) *Attorney, Agent, or Firm* — Paratus Law Group, PLLC

(57) ABSTRACT

Disclosed is a shield for eyelash extension of an eyelash extension system for extending a subject's eyelashes by bonding fake eyelashes thereto. The shield includes a safety cover divided into an upper body and a lower body such that front ends of the upper body and the lower body are paired to be opened or closed together to bite a subject's eyelashes placed therebetween. The safety cover includes a concave curved receiving groove in a front end of the safety cover to accommodate the subject's eyelashes while in contact with a protruding eye of the subject with his or her eye closed, and a work space with an entrance open to a rear side is provided behind the receiving groove. The work space is for accommodating the eyelashes pulled by being bitten between the front ends of the upper and lower bodies and conducting eyelash extension work therein.

7 Claims, 11 Drawing Sheets

(56) References Cited

U.S. PATENT DOCUMENTS

| | | | | |
|---|---|---|---|---|
| 3,590,828 | A * | 7/1971 | Prewitt | A45D 44/12<br>132/216 |
| 6,220,252 | B1 * | 4/2001 | Heintz | A45D 2/48<br>132/216 |
| 2013/0152960 | A1 * | 6/2013 | Pays | A45D 8/00<br>132/216 |

FOREIGN PATENT DOCUMENTS

| | | | |
|---|---|---|---|
| KR | 20-0165452 | B1 | 2/2000 |
| KR | 20-0242063 | Y1 | 10/2001 |
| KR | 10-2005-0094973 | A | 9/2005 |
| KR | 10-1342686 | B1 | 1/2014 |
| KR | 10-1390002 | B1 | 4/2014 |

OTHER PUBLICATIONS

Korean Notice of Allowance for related KR Application No. 10-2019-0028700 dated Jun. 24, 2020 from Korean Intellectual Property Office.

* cited by examiner

EYELASH EXTENSION SYSTEM

CROSS-REFERENCE TO RELATED APPLICATION

This application claims priority to and the benefit of Korean Patent Application No. 10-2019-0028700, filed on Mar. 13, 2019, the disclosure of which is incorporated herein by reference in its entirety.

BACKGROUND

The present invention relates to an eyelash extension system, and more particularly, to an eyelash extension system capable of comfortably and safely protecting a subject's eye using a shield ergonomically designed in consideration of a degree of protrusion of the eyeball and a width of the eyehole of the subject, and simplifying eyelash extension work to remarkably improve operation efficiency.

In general, eyelashes are very important in terms of aesthetic aspect. Especially, women prefer curled long eyelashes and usually make their eyelashes be curled and look longer using mascara.

The easiest way in which mascara is widely used is to change eyelashes to a desired shape and color the eyelashes black. Basically, mascara is applicable to long eyelashes to change the eyelashes to look more beautiful.

When eyelashes are short, the eyelashes are extended by attaching fake eyelashes thereto to enhance aesthetic appearance. Fake eyelashes include an eyelash part consisting of a plurality of eyelashes and a base part for binding and holding the eyelashes together, and are attached to actual eyelashes on eyelids by applying an adhesive to the base part.

Such fake eyelashes need to be directly and accurately attached to eyelids by a user, and are very inconvenient to use when the user is not accustomed to using fake eyelashes, because it will take a large amount of time to attach the fake eyelashes.

In order to overcome the problem described above, Korean Registered Utility Model No. 20-0165452 discloses an attachment tool designed to easily attach eyelashes. However, such fake eyelashes are excellent in terms of aesthetic aspect but are disposable. Thus, it is necessary to attach new fake eyelashes whenever needed, and users should carry fake eyelashes outdoors.

When eyelashes are short, an eyelash extension procedure may be used instead of using fake eyelashes. The eyelashes extension procedure is usually conducted in skin care shops or beauty salons, and is advantageous in that long eyelashes can be obtained by attaching eyelash extensions via an adhesive and maintained for several months after the procedure. The related arts have been disclosed in this regard.

For example, Korean Patent Laid-Open Publication No. 10-2005-0094973 (Sep. 29, 2005) discloses a method of perming eyelashes. In this method, eyelash extensions are attached and resultant eyelashes are set. Thus, the eyelashes may be simply colored black using mascara after the performance of this method, thereby reducing a make-up time of the eyelashes. Furthermore, the resultant eyelashes can be maintained for a relatively long period by performing this method once.

However, much time and a high degree of skill are required because all operations of such an eyelash extension procedure are manually conducted. Especially, a process of bonding fake eyelashes to eyelashes via an adhesive is a difficult task that should be performed in a very delicate manner and thus cannot be performed all at once but is inevitably conducted in several parts. Furthermore, the related art has a serious problem that a risk of causing damage to a subject's eyes during the process is high.

SUMMARY

The present invention is directed to an eyelash extension system capable of comfortably and safely protecting a subject's eye using a shield ergonomically designed in consideration of a degree of protrusion of the eyeball and a width of the eyehole of the subject, and simplifying eyelash extension work to remarkably improve operation efficiency.

An aspect of the present invention provides a shield for eyelash extension of an eyelash extension system for extending a subject's eyelashes by bonding fake eyelashes thereto. The shield includes a safety cover divided into an upper body and a lower body such that front ends of the upper body and the lower body are paired to be opened or closed together to bite the subject's eyelashes placed therebetween. The safety cover includes a concave curved receiving groove in a front end of the safety cover to accommodate the subject's eyelashes while in contact with a protruding eye of the subject with his or her eye closed. A work space with an entrance open to a rear side is provided behind the receiving groove, in which the eyelashes pulled by being bitten between the front ends of the upper and lower bodies are accommodated and eyelash extension work is conducted.

Left and right sides of a rear end of the upper body and left and right sides of a rear end of the lower body may be hinge-coupled such that the front end of the upper body and the front end of the lower body are paired to be opened or closed together.

The safety cover may be formed such that a vertical width and a horizontal width thereof gradually increase toward the rear end from the front end, and thus a width of the work space of the safety cover gradually increases toward the entrance open to the rear side.

The shield may further include an upper lever extending upward from an upper side of the rear end of the upper body, and a lower lever extending downward from a lower side of the rear end of the lower body. The front ends of the upper body and the lower body which are normally closed may be opened when an external force of a certain level or higher is applied to press the upper lever downward and the lower lever upward.

The shield may further include a support frame installed at a position spaced apart from the rear side of the safety cover, the support frame being formed in a ring shape along the periphery of the entrance of the work space of the safety cover. Supports may be provided at a left portion and a right portion of the support frame, the supports being hinge-coupled to a left side and a right side of the rear end of the upper body and a left side and a right side of the rear end of the lower body.

The shield may further include springs configured to push an upper end of the upper body and a lower end of the lower body forward to close the front ends of the upper body and the lower body, the springs being installed at centers of an upper end and a lower end of the support frame.

The receiving groove may have a depth of 13.15 to 15.36 mm, a horizontal width of 32.44 to 36.05 mm, and a vertical width of 32.59 to 36.21 mm.

The front end of the safety cover in which the receiving groove is provided may have a radius of curvature of 21 to 22 mm, and an angle formed by the horizontal width of the front end of the safety cover may be 55.72°.

The safety cover may be formed of a transparent material.

Another aspect of the present invention provides a guard, for eyelash extension, of an eyelash extension system for extending a subject's eyelashes by bonding fake eyelashes thereto, which is configured to trim eyelash extensions while safely covering and protecting the subject's eye, after the bonding of the fake eyelashes to the subject's eyelashes is completed by a heating and bonding device. The guard includes a concave curved contact surface corresponding to a front end of the guard, wherein the contact surface comes into contact with a subject's eyelid when the subject places his or her closed eye thereon; and a slit cut along the contact surface to be long in a lateral direction such that the subject's eyelash extensions pass backward therethrough. A work space with an entrance open to a rear side is provided at a rear side of the contact surface, the work space that accommodates and trims the eyelash extensions pulled backward via the slit.

The guard may be formed such that a vertical width and a horizontal width thereof gradually increase toward a rear end from a front end, and thus a width of the work space gradually increases toward the entrance open to the rear side.

The slit may extend from the front end of the guard to rear ends of both sides thereof, and a horizontal width of the slit may increase toward the rear side, and the slit may have round ends. The slit in the front end of the guard may be further widened when an upper side and a lower side of the rear end of the guard are pressed by an external force.

The guard may further include an upper lever protrusion extending upward from the upper side of the rear end of the guard, and a lower lever protrusion extending downward from the lower side of the rear end of the guard. The slit in the front end of the guard may be further widened when an external force of a certain level or higher is applied to press the upper lever projection downward and press the lower lever projection upward.

The guard may be formed of a transparent polycarbonate (PC).

Another aspect of the present invention provides an eyelash extension system including the above-described shield; a heating and bonding device configured to bond the eyelashes and the fake eyelashes by gripping and heating the eyelashes and the fake eyelashes, which are temporarily adhered to each other via an adhesive, by grips inserted via the work space open to the rear side of the safety cover while the eyelashes are bitten by the safety cover of the shield covering the subject's eye; and a guard configured to trim the eyelash extensions while safely covering and protecting the subject's eye after the bonding of the fake eyelashes to the eyelashes is completed by the heating and bonding device.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1:
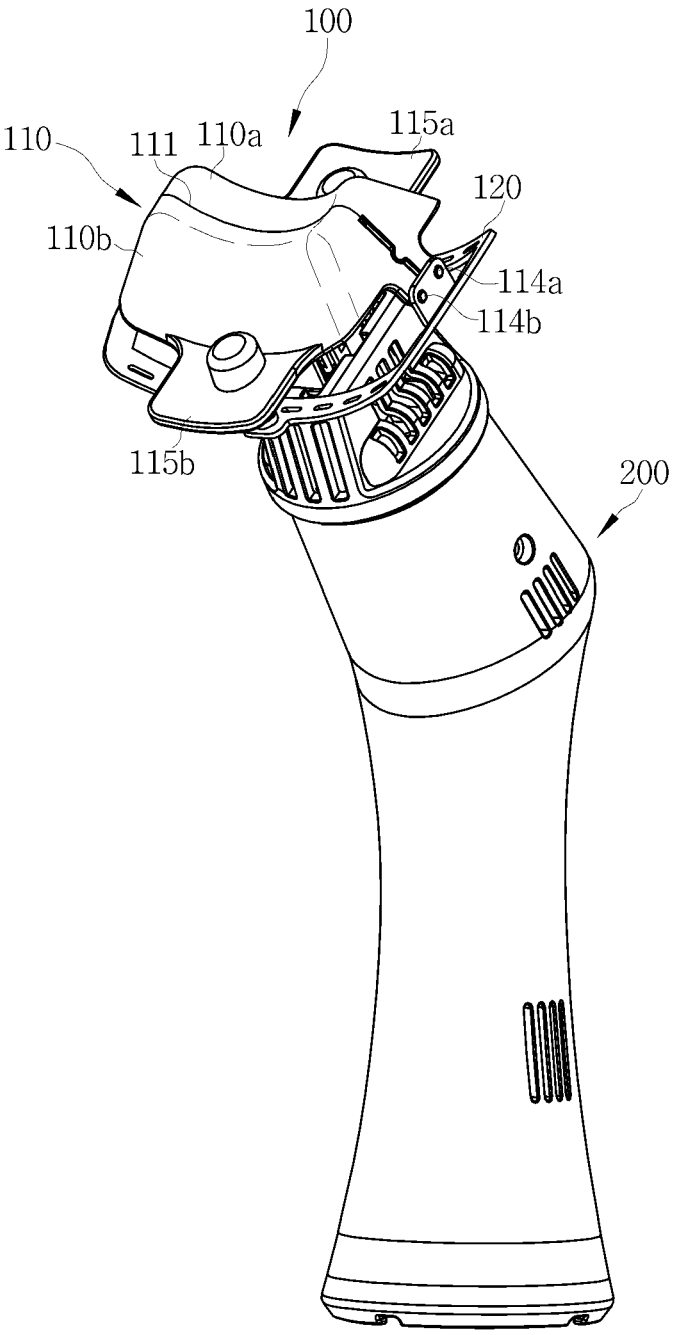
FIG. 1 is a perspective view of an eyelash extension system according to an embodiment of the present invention.

An eyelash extension system according to embodiments of the present invention will be described in detail with reference to the accompanying drawings below. Various modifications may be made in the present invention and the present invention may be embodied in many different forms. Thus, exemplary embodiments are illustrated in the drawings and described herein in detail. It should be understood that the present invention is not limited to these embodiments and is to cover all modifications, equivalents, and alternatives falling within the spirit and scope of the present invention. Like reference numerals are used for like elements in describing each drawing. In the accompanying drawings, the sizes of structures may be exaggerated for clarity or illustrated to be smaller than actual sizes thereof to help understand schematic configurations. As used herein, terms such as "first" and "second" may be used to describe various elements but should not be understood as being limited by these terms. The terms are used only for the purpose of distinguishing one element from another. For example, a first component could be termed a second component without departing from the scope of the present invention, and similarly, a second component could also be termed a first component. On the other hand, unless otherwise defined, all terms used herein, including technical or scientific terms, have the same meaning as commonly understood by one of ordinary skill in the art to which the present invention pertains. It will be understood that terms, such as those defined in commonly used dictionaries, should be interpreted as having a meaning that is consistent with their meaning in the context of the relevant art and will not be interpreted in an idealized or overly formal sense unless expressly so defined herein.

EMBODIMENTS

Figure 2:
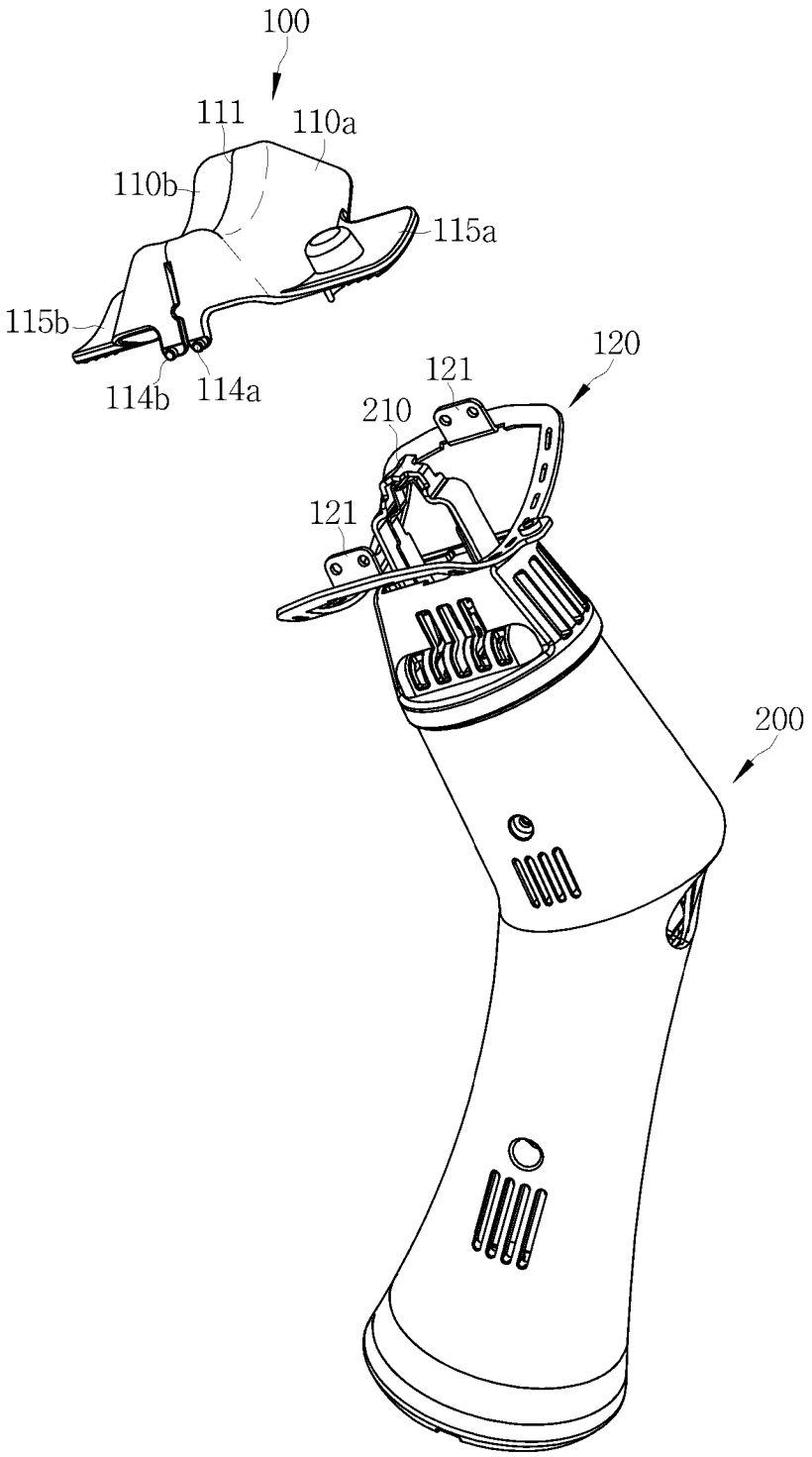
FIG. 2 is a partial exploded view of an eyelash extension system according to an embodiment of the present invention.
Figure 3:
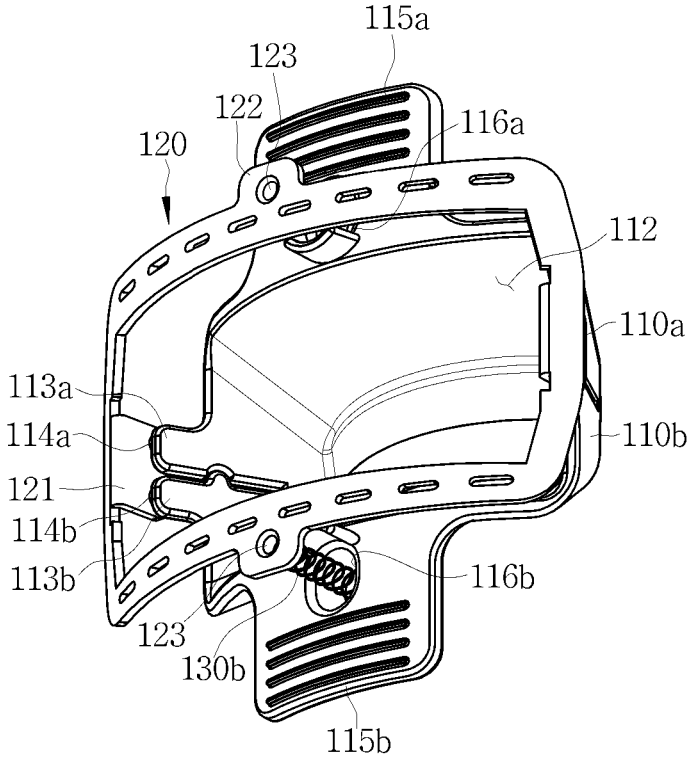
FIG. 3 is a perspective view for explaining a configuration of a shield of an eyelash extension system according to an embodiment of the present invention.
Figure 4:
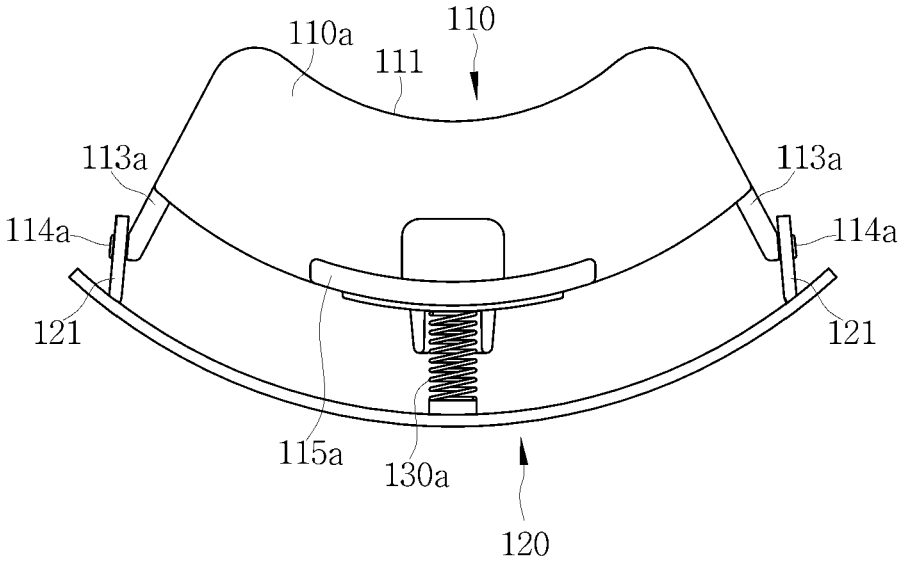
FIG. 4 is a plan view of a shield of an eyelash extension system according to an embodiment of the present invention.
Figure 5:
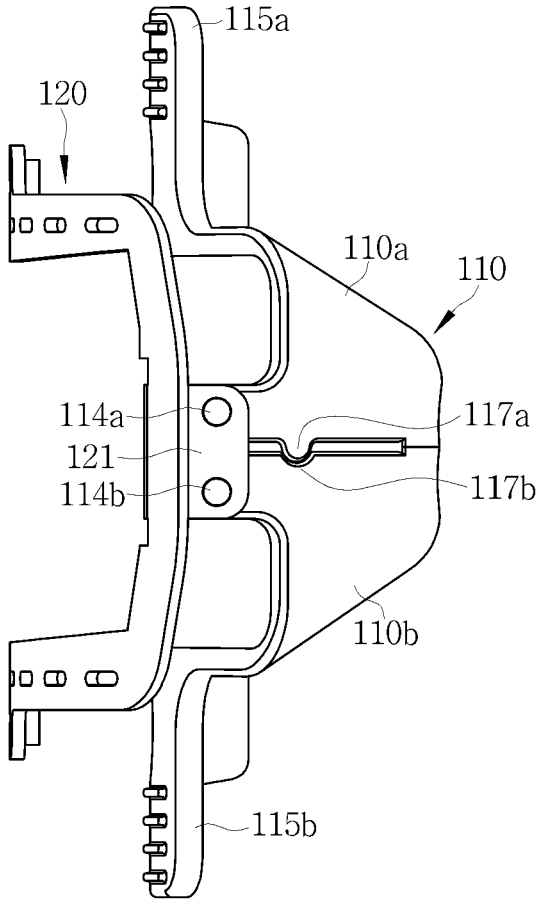
FIG. 5 is a side view of an eyelash extension system according to an embodiment of the present invention.
Figure 6:
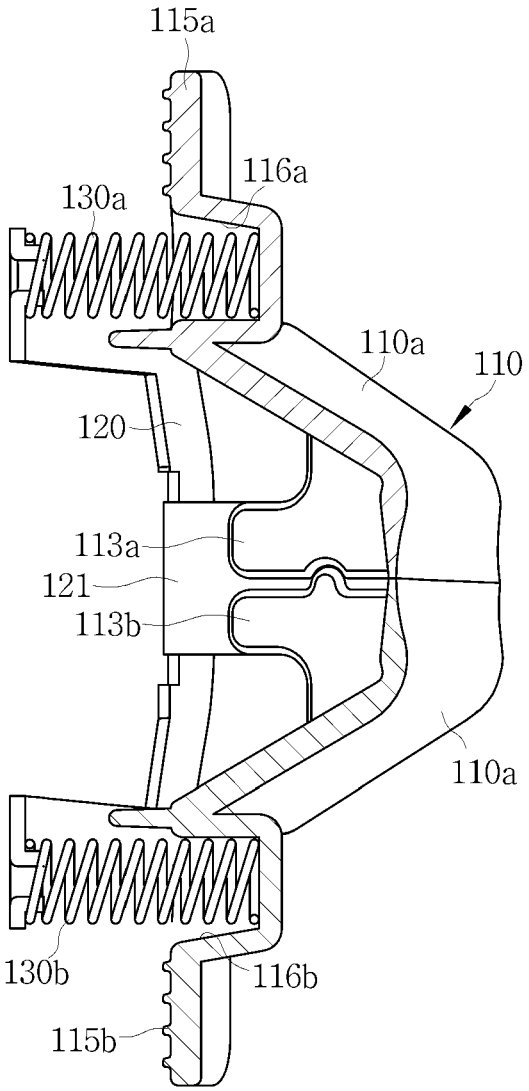
FIG. 6 is a side sectional view of a shield of an eyelash extension system according to an embodiment of the present invention.
Figure 7:
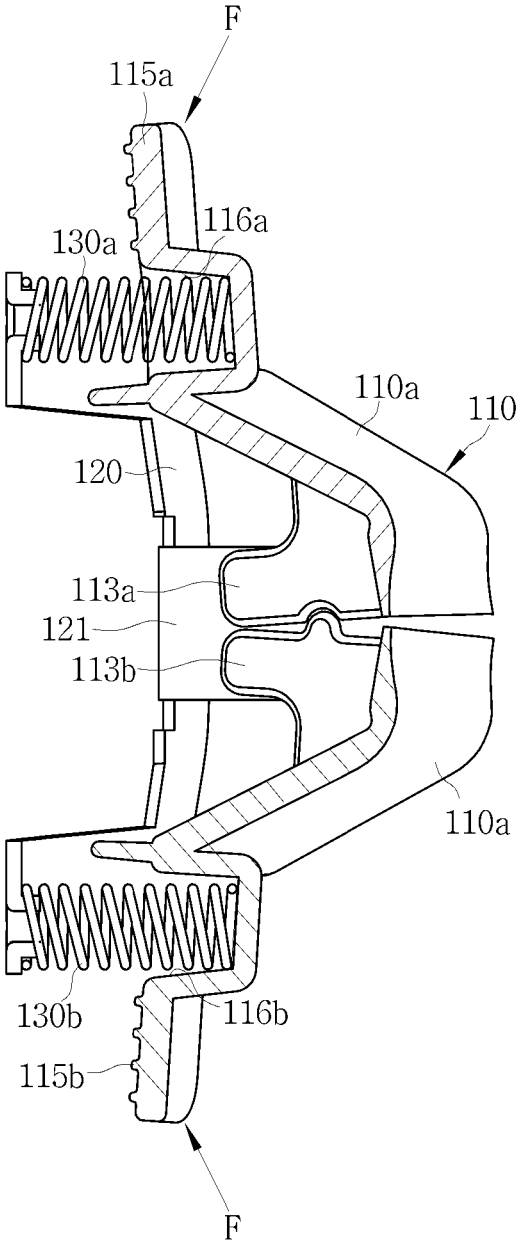
FIG. 7 is a reference diagram for explaining an operation of a shield of an eyelash extension system according to an embodiment of the present invention.

FIG. 1 is a perspective view of an eyelash extension system according to an embodiment of the present invention. FIG. 2 is a partial exploded view of an eyelash extension system according to an embodiment of the present invention. FIG. 3 is a perspective view of a shield of an eyelash extension system according to an embodiment of the present invention. FIG. 4 is a plan view of a shield of an eyelash extension system according to an embodiment of the present invention. FIG. 5 is a side view of an eyelash extension system according to an embodiment of the present invention. FIG. 6 is a side sectional view of a shield of an eyelash extension system according to an embodiment of the present invention. FIG. 7 is a reference diagram for explaining an operation of a shield of an eyelash extension system according to an embodiment of the present invention.

As illustrated in the drawings, the eyelash extension system according to the embodiment of the present invention includes a shield 100, a heating and bonding device 200, and a guard 300 to perform a series of operations of extending the eyelashes of a subject by bonding fake eyelashes to the eyelashes.

The present invention is directed to more comfortably and safely protecting a subject's eyes using the shield 100 ergonomically designed in consideration of a degree of protrusion of the eyeballs and horizontal and vertical widths of the eyeholes of the subject, and simplifying eyelash extension work to remarkably improve work efficiency.

The eyelash extension system according to the embodiment of the present invention will be described in more detail with respect to the shield 100 below.

As illustrated in FIGS. 1 to 7, the shield 100 is configured to facilitate eyelash extension work by biting eyelashes while safely protecting a subject's eye and includes a safety cover 110, a support frame 120, and springs 130*a* and 130*b*.

The safety cover 110 has a container type body, the rear side of which is open. The body is divided into an upper body 110*a* and a lower body 110*b* such that front ends of the upper body 110*a* and the lower body 110*b* are paired to be opened or closed together to bite the subject's eyelashes placed therebetween.

Figure 8:
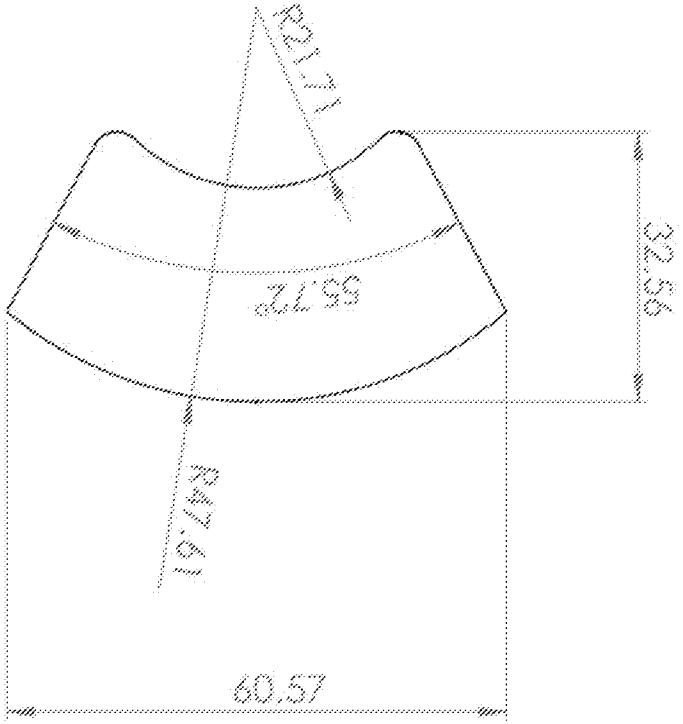
FIG. 8 is a reference diagram for explaining design dimensions of a safety cover accommodation portion of a shield of an eyelash extension system according to an embodiment of the present invention.

A front surface of a front end of the safety cover 110 is provided with a receiving groove 111 with a concave curved surface to accommodate therein the protruding eyeball of the subject with his or her eye closed while in contact with the safety cover 110. The receiving groove 111 is ergonomically designed in consideration of degrees of protrusion of the eyeballs and horizontal and vertical widths of the eyeholes of Asians/westerners, based on verified data, and has a depth of 13.15 to 15.36 mm, a horizontal width of 32.44 to 36.05 mm, and a vertical width of 32.59 to 36.21 mm. As illustrated in FIG. 8, a radius of curvature R of the front surface of the front end of the safety cover 110 is set to 21 to 22 mm, and an angle formed by the horizontal width of the receiving groove 111 is set to 55.72°. Due to the configuration of the receiving groove 111, the safety cover 110 may be comfortably brought into contact with the eyeball of the subject and the periphery thereof under uniform pressure. Here, the degrees of protrusion of the eyeballs and the horizontal widths of the eyeholes of Asians and westerners are substantially the same but the vertical widths of the eyeholes thereof are significantly different. Thus, based on the difference, shields are preferably provided by applying thereto these numerical values for Asians and westerners and selectively used.

In the safety cover 110, a work space 112 with an entrance open to a rear side is provided behind the receiving groove 111, in which eyelashes pulled backward by being bitten between the front ends of the upper body 110*a* and the lower body 110*b* may be accommodated and eyelash extension work and finishing work may be conducted. Here, the safety cover 110 is formed such that the horizontal and vertical widths thereof gradually increase in a direction from top to bottom, and similarly, a width of the work space 112 gradually increases toward the entrance thereof. When the width of the work space 112 gradually increases toward the entrance thereof as described above, various operations may be very conveniently performed on eyelashes using various tools in the work space 112. The safety cover 110 is formed of a transparent polycarbonate (PC) and thus all operations performed in the work space 112 may be observed with naked eyes.

Left and right sides of a lower end of each of the upper and lower bodies 110*a* and 110*b* are respectively provided with an upper extension 113*a* and a lower extension 113*b* extending rearward in order that the front ends of the upper body 110*a* and the lower body 110*b* divided from the safety cover 110 may be paired to be opened or closed together. The upper extension 113*a* and the lower extension 113*b* are hinge-coupled to be rotatable about hinge shafts 114*a* and 114*b* with respect to supporters 121 located at left and right sides of the support frame 120. As illustrated in FIG. 5, the upper extension 113*a* and the lower extension 113*b* are preferably provided with a matching protrusion 117*a* and a matching groove 117*b* for matching.

A line dividing the safety cover 110 into the upper body 110*a* and the lower body 110*b* extends to a side of the safety cover 110 while crossing the front surface of the front end of the safety cover 100 in which the receiving groove 111 is formed to be vertically divided.

In the safety cover 110, an upper portion of the rear end of the upper body 110*a* and a lower portion of the rear end of the lower body 110*b* are respectively provided with an upper lever 115*a* extending upward and a lower lever 115*b* extending downward. Accordingly, as illustrated in FIG. 7, when the upper lever 115*a* and the lower lever 115*b* are pressed downward and upward by a practitioner's finger at a pressure of a predetermined level or higher, the front ends of the upper body 110*a* and the lower body 110*b* which are normally closed are displaced upward and downward and opened such that the subject's eyelashes may be inserted therebetween. In this state, when the external force is removed, the eyelashes are directly bitten by the front ends of the upper body 110*a* and the lower body 110*b*.

The support frame 120 is installed behind the safety cover 110 to be spaced apart from the safety cover 110 and is formed in a rectangular ring shape along the periphery of the entrance of the work space 112 of the safety cover 110. In addition, as described above, the left and right sides of the support frame 120 extend forward to form the supporters 121 to be rotatable about the hinge shafts 114*a* and 114*b* at the left and right sides of the rear ends of the upper body 110*a* and the lower body 110*b*.

The springs 130*a* and 130*b* are preferably in the form of coil-type compression springs as illustrated in FIGS. 6 and 7. The springs 130*a* and 130*b* are installed forward in a state in which the rear ends thereof are restrained by spring supports 122, which are provided at centers of upper and lower ends of the support frame 120, via restraining pins 123, so that the center of the upper end of the upper body 110*a* and the center of the lower end of the lower body 110*b* may be pressed forward. Front ends of the springs 130*a* and 130*b* are respectively inserted into an upper seating groove 116*a* formed in the rear end of the upper body 110*a* of the safety cover 110 and a lower seating groove 116*b* formed in the rear end of the lower body 110*b* of the safety cover 110. Due to the springs 130*a* and 130*b*, the front ends of the upper body 110*a* and the lower body 110*b* tend to be continuously closed unless an external force of a certain level or higher is applied thereto by the upper lever 115*a* and the lower lever 115*b*.

Generally, the above-described shield 100 for eyelash extension is attached to the subject's eyelid while biting the eyelashes, immediately after fake eyelashes are temporarily adhered to the eyelashes via an adhesive. In this case, it is necessary to bite the eyelashes such that a base of the fake eyelashes to which the adhesive is applied is accurately positioned in the work space 112 of the shield 100. When the shield 100 is accurately attached to the subject's eye as described above, the base of the fake eyelashes temporarily adhered to the eyelashes via the adhesive is gripped by grips 210 on the heating and bonding device 200 and then heated to firmly bond the fake eyelashes with the eyelashes. In this case, the subject's eye is safely protected from the grips 210, which are heated to a high temperature, by the shield 100 attached to the subject's eyelid, and the eyelashes and the fake eyelashes are bitten by the shield 100 having a width sufficient to completely accommodate the horizontal width of the eyehole of the subject. Thus, the fake eyelashes may be heated and bonded all at once without repeatedly adding and heating one piece of the fake eyelashes at a time.

Thereafter, finishing work of removing a residue of the adhesive and trimming the eyelash extensions using simple tools may be conducted while the shield 100 is attached to the subject's eye.

As illustrated in FIGS. 1 and 2, the pair of grips 210 are provided on a front end of the heating and bonding device 200 included in the eyelash extension system according to the present invention to grip eyelashes and deliver high heat to the eyelashes. A main body of the heating and bonding device 200 is used as a handle, and a motor and a gear assembly for operating the grips 210, a heater for generating high heat and delivering the high heat to the grips 210, and the like are installed inside the main body. In the heating and bonding device 200, it is preferable that the grips 210 be automatically controlled by turning on a switch installed in the main body once to perform a series of operations of opening and closing the grips 210 to heat the eyelashes for a certain time while the eyelashes are gripped by the grips 210 and thereafter opening the grips 210.

Figure 9:
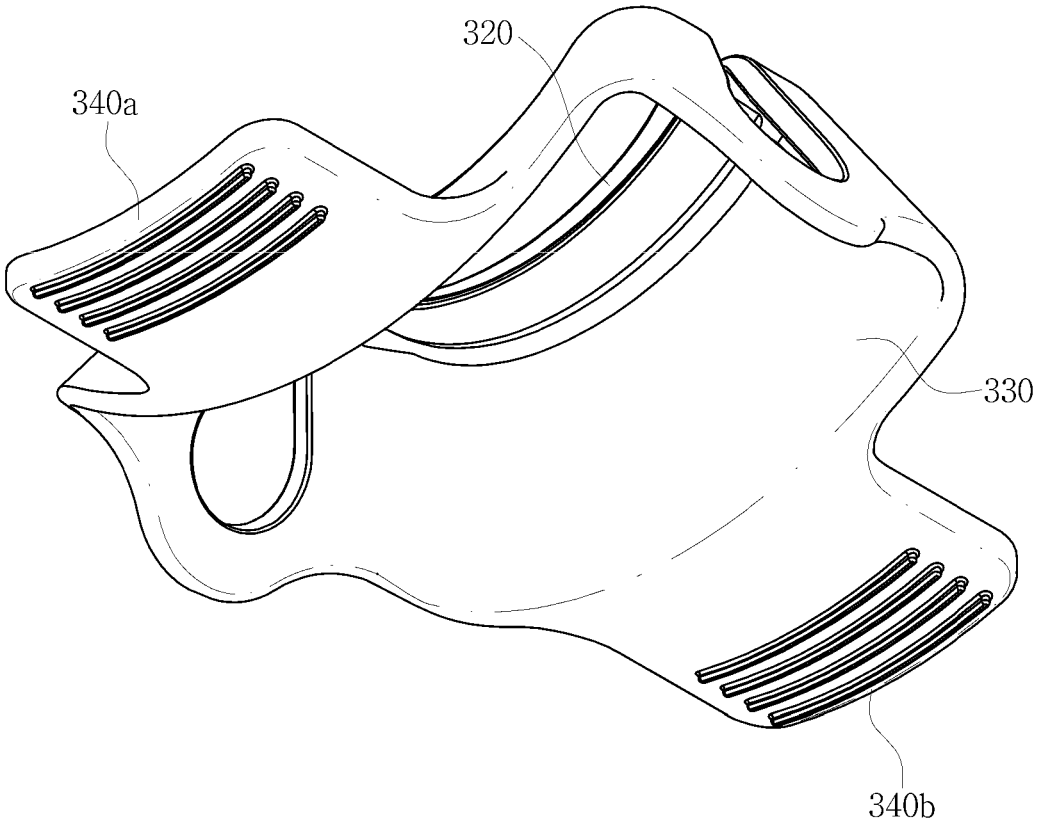
FIG. 9 is a top perspective view for explaining a configuration of a guard of an eyelash extension system according to an embodiment of the present invention.
Figure 10:
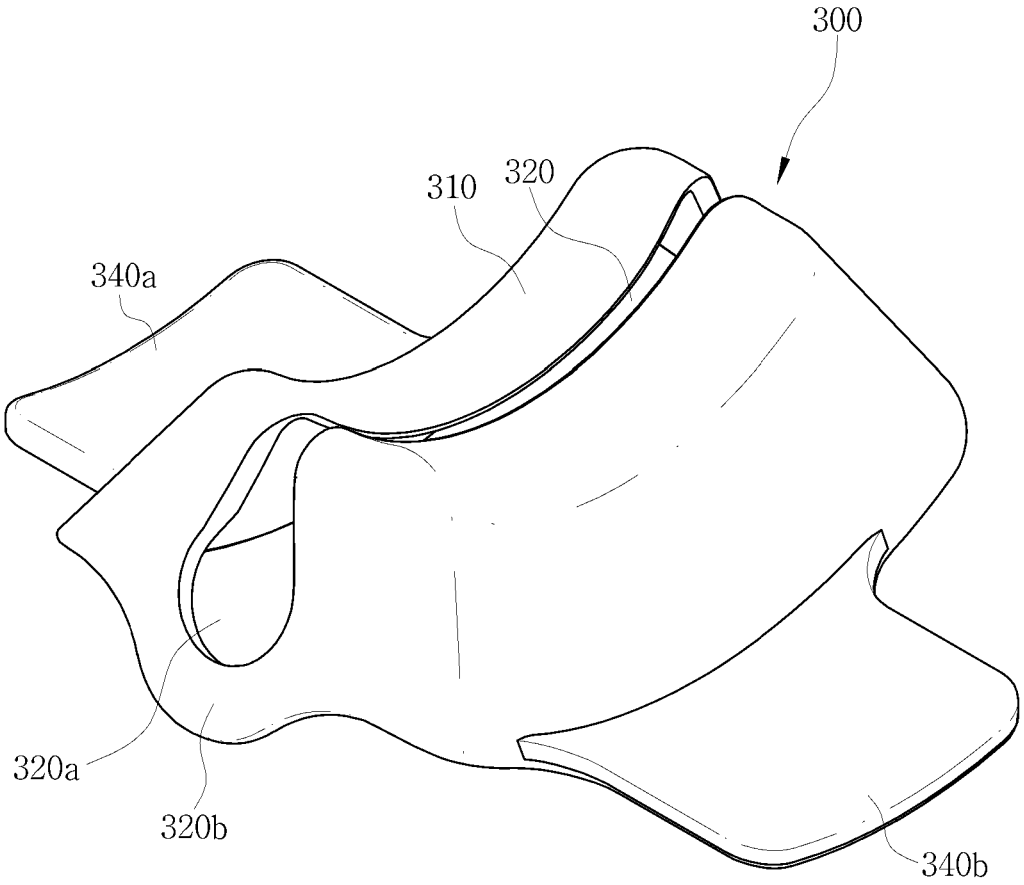
FIG. 10 is a bottom perspective view for explaining a configuration of a guard of an eyelash extension system according to an embodiment of the present invention.
Figure 11:
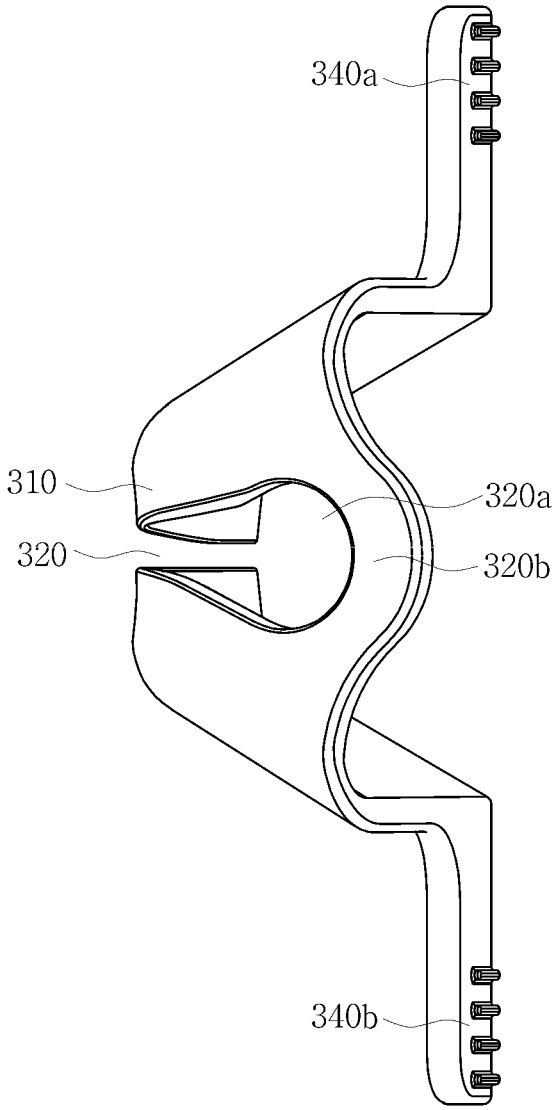
FIG. 11 is a side view for explaining a configuration of a guard of an eyelash extension system according to an embodiment of the present invention.

FIGS. 9 to 11 are a top perspective view, a bottom perspective view, and a side view for explaining a configuration of a guard of an eyelash extension system according to an embodiment of the present invention.

In the embodiment of the present invention, a guard 300 for eyelash extension is used to safely cover and protect a subject's eye and to safely perform trimming work, including combing and curling, on eyelash extensions, after bonding of fake eyelashes to the subject's eyelashes to extend the subject's eyelashes is completed.

To this end, the guard 300 includes a concave curved contact surface 310, which corresponds to an entire front end of the guard 300 and comes into contact with an eye of the subject with his or her eye closed when the guard 300 is placed on the subject's eye, and a slit 320 which is cut along the contact surface 310 to be long in a lateral direction and allows the subject's eyelash extensions to pass backward therethrough. A rear side of the contact surface 310 is provided as a work space with an entrance open to a rear side, in which the eyelash extensions pulled backward via the slit 320 may be accommodated and trimmed.

A vertical width and a horizontal width of a body of the guard 300 gradually increase in a direction from top to bottom. Accordingly, a width of the work space inside the body of the guard 300 gradually increases toward the open entrance at the rear side, and thus it is easy to trim the eyelash extensions by inserting small-sized tools via the rear side.

Here, the slit 320 extends from a front surface of the front end of the guard 300 to lower ends of both sides of the guard 300, vertical widths of sides of the slit 320 increase in a direction from top to bottom, and the slit 320 has round ends. Due to the configuration of the slit 320, the body of the guard 300 is divided into substantially two parts with respect to the slit 320, and the two parts of the guard 300 may be elastically connected via a connecting portion 320*b* at both ends of the slit 320.

When upper and lower sides of the rear end of the guard 300 are pressed by an external force due to the configuration of the slit 320, the slit 320 in the front end of the guard 300 is widened.

An upper lever protrusion 340*a* and a lower lever protrusion 340*b* are formed on the upper and lower sides of the rear end of the guard 300, respectively. Due to the upper and lower lever protrusions 340*a* and 340*b*, when an external force of a certain level or higher is applied upward and downward via the upper and lower lever protrusions 340*a* and 340*b*, the slit 320 in the front end of the guard 300 becomes widened and thus the subject's eyelash extensions may be drawn into the slit 320 more easily.

Generally, the guard 300 for eyelash extension may be used after fake eyelashes are heated and bonded to the subject's eyelashes. In this case, the eyelash extensions are passed backward via the slit 320 in the front end of the guard 300 such that most of the eyelash extensions are positioned in the work space of the guard 300. In this state, finishing work, including combing and curling, may be safely performed on the eyelash extensions accommodated in the work space.

An eyelash extension system according to the present invention is capable of comfortably and safely protecting an eye using a shield ergonomically designed in consideration of a degree of protrusion of an eyeball and a width of an eyehole, and simplifying eyelash extension work to remarkably improve work efficiency.

In addition, according to the present invention, a guard allows a subject's eyelashes to pass backward therethrough to be positioned in a work space, while in contact with a subject's eye, when the eye is placed thereon, and thus finishing work, including combing and curling, may be safely and efficiently performed.

While the exemplary embodiments of the present invention have been described above, various modifications, changes, and equivalents may be made therein. It is clear that the above embodiments of the present invention may be appropriately modified and applied similarly. Accordingly, the scope of the present invention defined in the claims should not be understood as being limited by the above description.

What is claimed is:

1. A shield for eyelash extension of an eyelash extension system for extending a subject's eyelashes by bonding fake eyelashes thereto, the shield comprising a safety cover divided into an upper body and a lower body such that front ends of the upper body and the lower body are paired to be opened or closed together to bite a subject's eyelashes placed therebetween, wherein the safety cover comprises a concave curved receiving groove in a front end of the safety cover to accommodate the subject's eyelashes while in contact with a protruding eye of the subject with his or her eye closed, a work space with an entrance open to a rear side is provided behind the receiving groove, the work space for accommodating the eyelashes pulled by being bitten between the front ends of the upper and lower bodies and conducting eyelash extension work therein, wherein left and right sides of a rear end of the upper body and left and right sides of a rear end of the lower body are hinge-coupled such that the front end of the upper body and the front end of the lower body are paired to be opened or closed together, wherein the shield further comprises:

an upper lever extending upward from an upper side of the rear end of the upper body; and a lower lever extending downward from a lower side of the rear end of the lower body, wherein the front ends of the upper body and the lower body which are normally closed are opened when an external force of a certain level or higher is applied to press the upper lever downward and the lower lever upward, wherein the shield further comprises:

a support frame installed at a position spaced apart from the rear side of the safety cover, the support frame being formed in a ring shape along the periphery of the entrance of the work space of the safety cover, wherein supports are provided at a left portion and a right portion of the support frame, the supports being hinge-coupled to a left side and a right side of the rear end of the upper body and a left side and a right side of the rear end of the lower body.

2. The shield of claim 1, wherein the safety cover is formed such that a vertical width and a horizontal width thereof gradually increase toward the rear end from the front end, and thus a width of the work space of the safety cover gradually increases toward the entrance open to the rear side.

3. The shield of claim 1, further comprising springs configured to push an upper end of the upper body and a lower end of the lower body forward to close the front ends of the upper body and the lower body, the springs being installed at centers of an upper end and a lower end of the support frame.

4. The shield of claim 1, wherein the receiving groove has a depth of 13.15 to 15.36 mm, a horizontal width of 32.44 to 36.05 mm, and a vertical width of 32.59 to 36.21 mm.

5. The shield of claim 4, wherein the front end of the safety cover in which the receiving groove is provided has a radius of curvature of 21 to 22 mm, and an angle formed by the horizontal width of the front end of the safety cover is 55.72°.

6. The shield of claim 1, wherein the safety cover is formed of a transparent material.

7. An eyelash extension system for extending a subject's eyelashes by bonding fake eyelashes thereto, the eyelash extension system comprising:

the shield of claim 1; and a heating and bonding device configured to bond the eyelashes and the fake eyelashes by gripping and heating the eyelashes and the fake eyelashes, which are temporarily adhered to each other via an adhesive, by grips inserted via the work space open to the rear side of the safety cover while the eyelashes are bitten by the safety cover of the shield covering the subject's eye.

* * * * *